US006676570B2

(12) United States Patent
Valentino

(10) Patent No.: US 6,676,570 B2
(45) Date of Patent: Jan. 13, 2004

(54) ADJUSTABLE REHABILITATION EXERCISE DEVICE

(76) Inventor: Alexander Valentino, 516 Hirsch Ave., Runnemede, NJ (US) 08078

( * ) Notice: Subject to any disclaimer, the term of this patent is extended or adjusted under 35 U.S.C. 154(b) by 381 days.

(21) Appl. No.: 09/824,831

(22) Filed: Apr. 3, 2001

(65) Prior Publication Data

US 2002/0094913 A1 Jul. 18, 2002

Related U.S. Application Data

(63) Continuation-in-part of application No. 09/174,604, filed on Oct. 19, 1998, now abandoned.

(51) Int. Cl.[7] ..... A63B 23/14

(52) U.S. Cl. ..... 482/45; 482/46; 482/114

(58) Field of Search ..... 482/44–46, 49, 482/55, 79, 80, 114–118

(56) References Cited

U.S. PATENT DOCUMENTS

| | | | | |
|---|---|---|---|---|
| 4,557,479 A | | 12/1985 | Guibert | |
| 5,167,596 A | | 12/1992 | Ferber | |
| 5,445,581 A | | 8/1995 | Ferber | |
| 5,536,223 A | | 7/1996 | Ferber | |
| 5,580,336 A | | 12/1996 | Coallier | |
| 5,820,521 A | | 10/1998 | Edwards et al. | |
| 5,967,949 A | * | 10/1999 | Davenport | 482/93 |

* cited by examiner

*Primary Examiner*—Glenn E. Richman
(74) *Attorney, Agent, or Firm*—Norman E. Lehrer

(57) ABSTRACT

An exercise device with an elongated, angular body having a first end and a second end where the first end has a first chuck and the second end has a second chuck is disclosed. The first and second chucks are adapted to hold many different sizes, shapes, textures, and styles of turning knobs. The exercise device includes a tripod upon which the body may be mounted. The device also includes different gear ranges so that a range of resistance levels is available. A variety of different styles of turning knobs may be used with the device in order to provide a range of prehension, or grasping and seizing actions made by the hand.

7 Claims, 5 Drawing Sheets

ADJUSTABLE REHABILITATION EXERCISE DEVICE

CROSS REFERENCE TO RELATED APPLICATIONS

This application is a Continuation-In-Part of U.S. patent application Ser. No. 09/174,604 filed Oct. 19, 1998 now abandoned.

BACKGROUND OF THE INVENTION

The present invention is directed toward an exercise device and more particularly, toward an exercise device which aids in rehabilitating a person's hands and arms.

Currently, a reconditioning device that directly targets the twisting force caused by the prehensile action of the cylindrical and helical curving movements involving the entire metacarpal regions of the hand is not available. These particular movements are usually made during a "working action" type of situation where the movements are not premeditative or accomplished in calculated steps. They are everyday movements that are unconsciously made, such as removing tops from jars and bottles, or turning any type of circular knob, such as a doorknob or control knob, especially those with much resistance. After injuring metacarpal regions of the hand, these simple, nonpremeditative movements can be extremely painful and can prevent a person from making them.

Because of the uneven twisting force being applied to the muscles and tendons surrounding the many small bones of the hand, these exact movements are often difficult to duplicate during occupational therapy sessions using the current exercise equipment available today for the fingers, hand, wrist, or forearm.

An exercise device currently available on the market is the "ROLYAN Resistive Prehension Bench". "ROLYAN" is a trademark owned by Smith and Nephew Companies. This device, however, is limited in its usage, such as its accessibility, position adjustability, and its direct targeting of the injured or weakened area of the limb. Also, this machine uses means for resistance and prehension which are not very efficient. That is, the device is made up of springs, connected to a board, which can easily wear out.

An unchanging, consistent degree of resistance that is concentrated directly on the injured, or weakened area, is what is needed for maximum efficiency. There are treatment devices on the market that involve the use of ordinary nuts and bolts that can be connected to a board or platform. These nuts and bolts are to be turned by the hand, thus creating a reconditioning exercise. However, this is not a very efficient way of directly treating the injured area, especially the metacarpal areas of the hand, since there is no specific adjustment for tension, or resistance, involved with the free-flowing movement of nuts riding along the threads of bolts. Also, there is a limited amount of travel of the nuts and bolts.

A need exists for a more durable and efficient exercise device which concentrates on reconditioning and strengthening the hand, fingers, wrist, and forearm.

SUMMARY OF THE INVENTION

The present invention is designed to overcome the deficiencies of the prior art discussed above. It is an object of the present invention to provide an exercise device which creates and produces a prehensile, reconditioning, and strengthening exercising motion which emphasizes the cylindrical, spiraling, helical curving, and oblique angling movements of the metacarpal areas of the hand.

It is a further object of the present invention to provide an exercise device which rehabilitates the fingers, wrist, and forearm involving radial and ulnar deviation.

In accordance with the illustrative embodiments demonstrating features and advantages of the present invention, there is provided an exercise device with an elongated, angular body having a first end and a second end where the first end has a first holding means and the second end has a second holding means. The holding means may be first and second chucks. The first and second chucks are adapted to hold many different sizes, shapes, textures, and styles of turning means or knobs. The exercise device also includes a support means such as a tripod upon which the body may be mounted and includes means for mounting the body to the tripod. The device also includes different gear ranges so that a range of resistance levels is available. A variety of different styles of turning knobs may be used with the device in order to provide a range of prehension, or grasping and seizing actions made by the hand. In order to use the device, a person would take hold of, or grasp, one of the turning knobs, connected into one of the chucks, with one of his/her hands and then would try to turn the knob. The person would have the option of choosing and using different settings of turning tension, or resistance, by means of a switch. The person would also have the option of choosing and using different grades of prehension by switching to different styles and sizes of turning knobs. These turning knobs have unlimited travel in either direction without change in resistance. The device is fully adjustable to different heights, angles, positions of rotation, and positions of overall support by means of an adjustable, sturdy, telescoping, tripod stand, with a universal, ball-bearing-type clamp that connects to its body and can be maneuvered into practically any position or angle.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
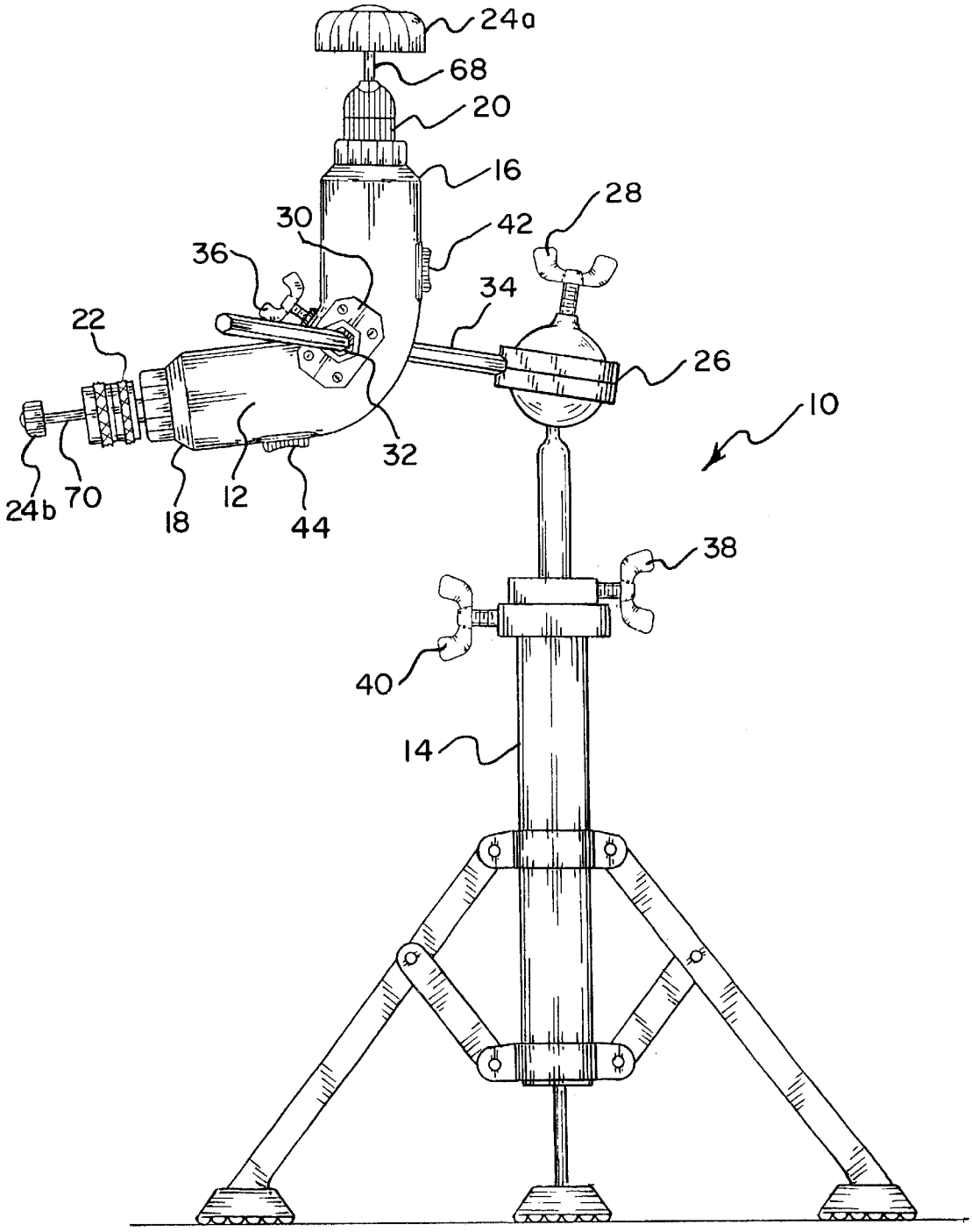
FIG. 1 is a front elevational view of the exercise device of the present invention mounted on a support stand.
Figure 2:
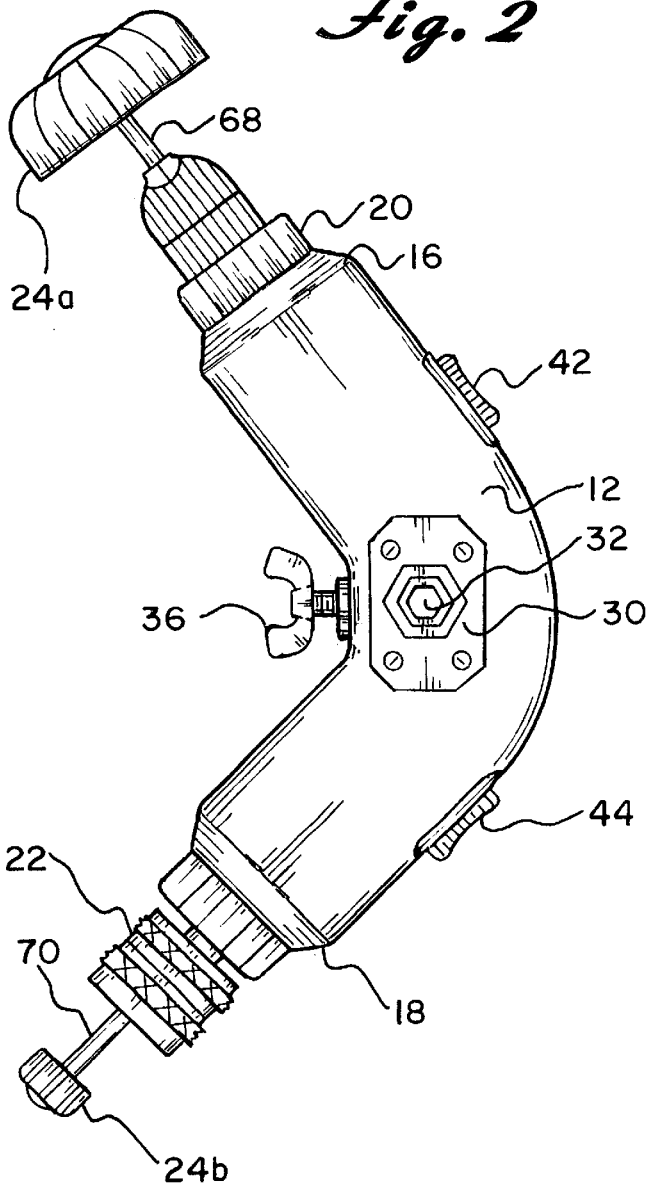
FIG. 2 is a front elevational view of the exercise device of the present invention without the support stand.
Figure 3:
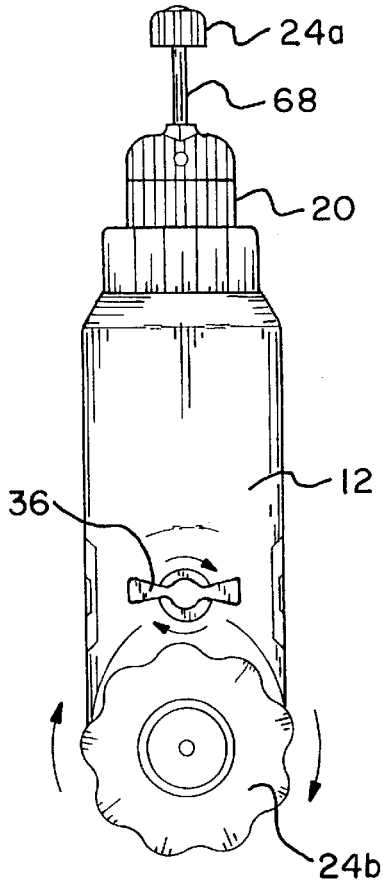
FIG. 3 is a partial view of the body of the exercise device of the present invention.
Figure 4:
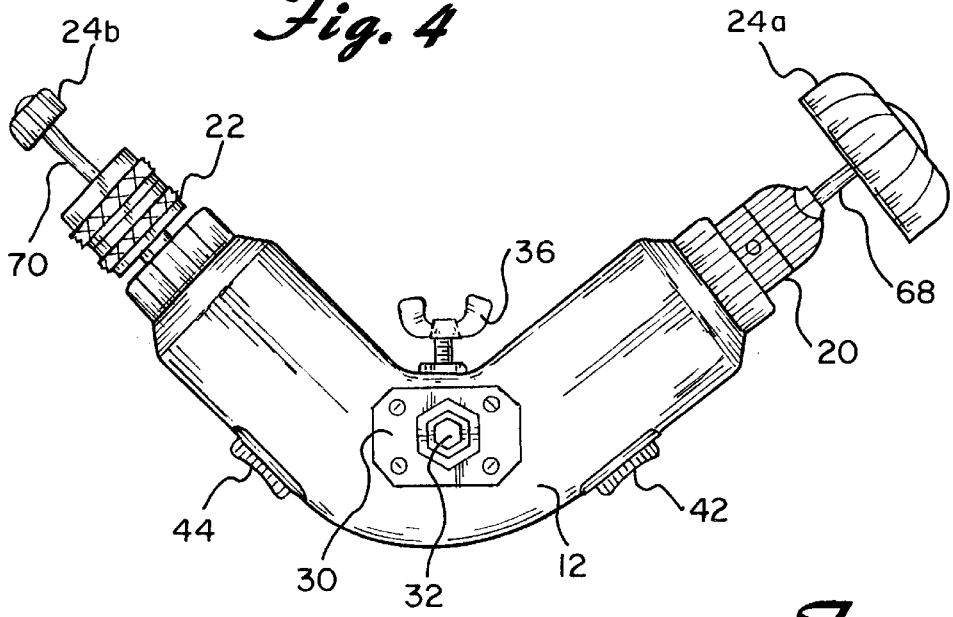
FIG. 4 is a front elevational view of the exercise device of the present invention.
Figure 5:
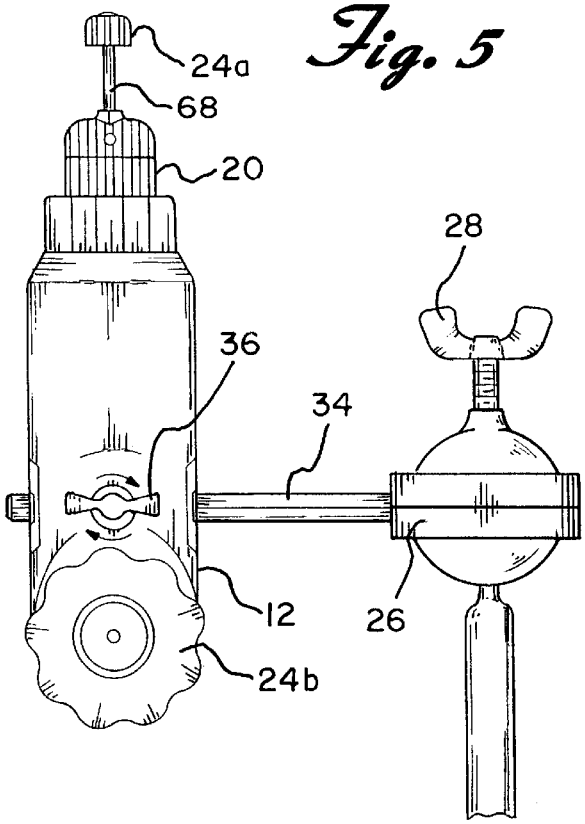
FIG. 5 is a partial view of the body of the exercise device of the present invention.
Figure 6:
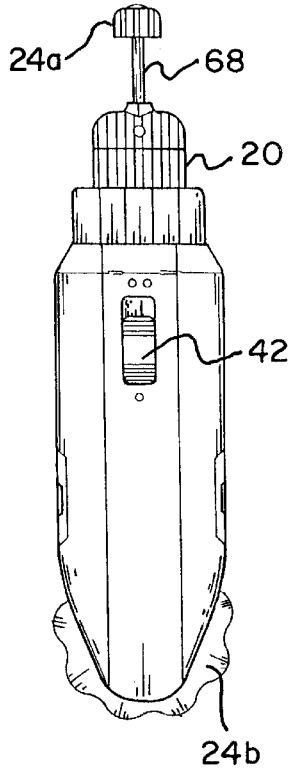
FIG. 6 is a rear elevational view of the body of the exercise device of the present invention.
Figure 7:
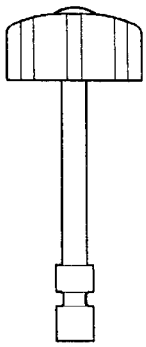
FIGS. 7–13 illustrate different styles of turning knobs that can be used when connected to the exercise device of the present invention.
Figure 8:
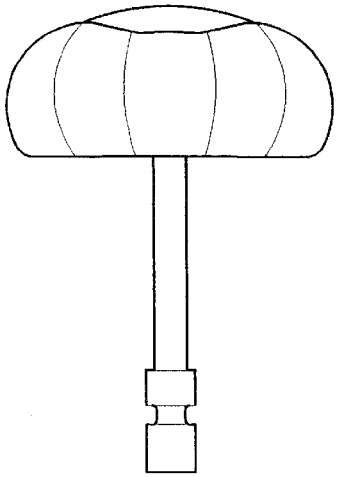
Figure 9:
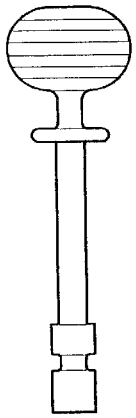
Figure 10:
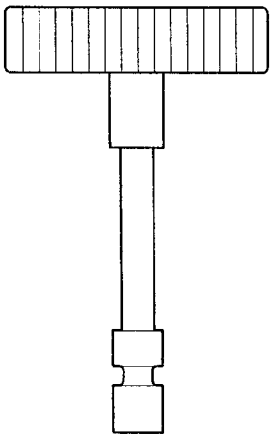
Figure 11:
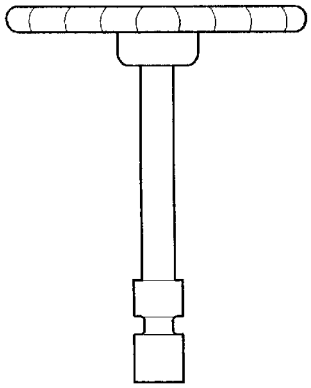
Figure 12:
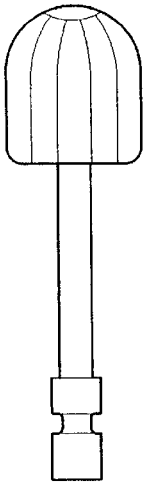
Figure 13:
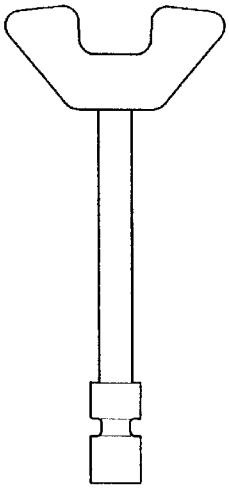

Referring now to the drawings in detail wherein like reference numerals have been used throughout the various figures to designate like elements, there is shown in FIG. 1 an exercise device constructed in accordance with the principles of the present invention and designated generally as 10.

The exercise device of the present invention essentially includes an elongated, angled body 12 and means 14 for supporting the body 12 thereon. The body 12 has a first end 16 and a second end 18. The first end 16 has a first holding means 20 and the second end 18 has a second holding means 22. The first and second holding means 20 and 22 may be chucks. The first and second chucks 20 and 22 are adapted to hold many different sizes, shapes, textures, and styles of turning means 24*a* and 24*b* or knobs. The device also includes different gear ranges so that a range of resistance levels is available. A variety of different styles of turning knobs may be used with the device in order to provide a range of prehension, or grasping and seizing actions made by the hand. (See FIGS. 7–13.)

The support means 14 may include a stand or tripod upon which the body 12 may be mounted. Means for mounting the body 12 to the tripod includes a ball clamp assembly 26 which may be adjusted via a wing bolt 28. The ball clamp assembly 26 is connected to a mounting bracket 30 which is connected adjacent the center of the body 12. (See FIG. 1.) The mounting bracket 30 contains a female opening 32 which may be hexagonally-shaped. The opening 32 extends through the center of the body 12. As a result, the body 12 may be mounted to the tripod 14 from either side and fits tightly around the male shaft 34 of the ball clamp assembly 26. The shaft 34 may be hexagonally-shaped. The body 12 is tightened down with a wing bolt 36 which is connected through the female opening 32 of the mounting bracket 30. The ball clamp 26 fits snugly into the tripod 14. The height of the tripod may be adjusted using wing bolts 38 and 40. The tripod, clamp assembly, and the mounting bracket allow for the body to be fully adjustable to different heights, angles, positions of rotation, and positions of overall support. The tripod may be made from metal or the like.

Manual switches 42 and 44 are mounted on the body 12 and are used for switching to different levels or grades of resistance that are felt as a result of rotating the turning knobs. The person using the exercise device may turn the knob in either direction with no change in the predetermined resistance setting. The resistance always remains constant at any point of the knob's rotation.

In order to use the device, a person grasps one of the turning knobs 24*a*, for example, connected into chuck 20 with one of his/her hands and would then try to turn the knob 24*a*. The person would have the option of choosing and using different settings of turning tension, or resistance, by means of a switch 42, for example. The person would also have the option of choosing and using different grades of prehension by switching to different styles and sizes of turning knobs. (See FIGS. 7–13.) These turning knobs have unlimited travel in either direction without change in resistance.

The different gear ranges of the device are used for different ranges of resistance needed for reconditioning exercises, and the variety of different styles of turning knobs are used for different ranges of prehension, or grasping and seizing actions made by the hand, which are also used for rehabilitation. The device contains small gears which are enclosed and secured within an overall, protecting shell, or casing. (See FIG. 15.)

Figure 15:
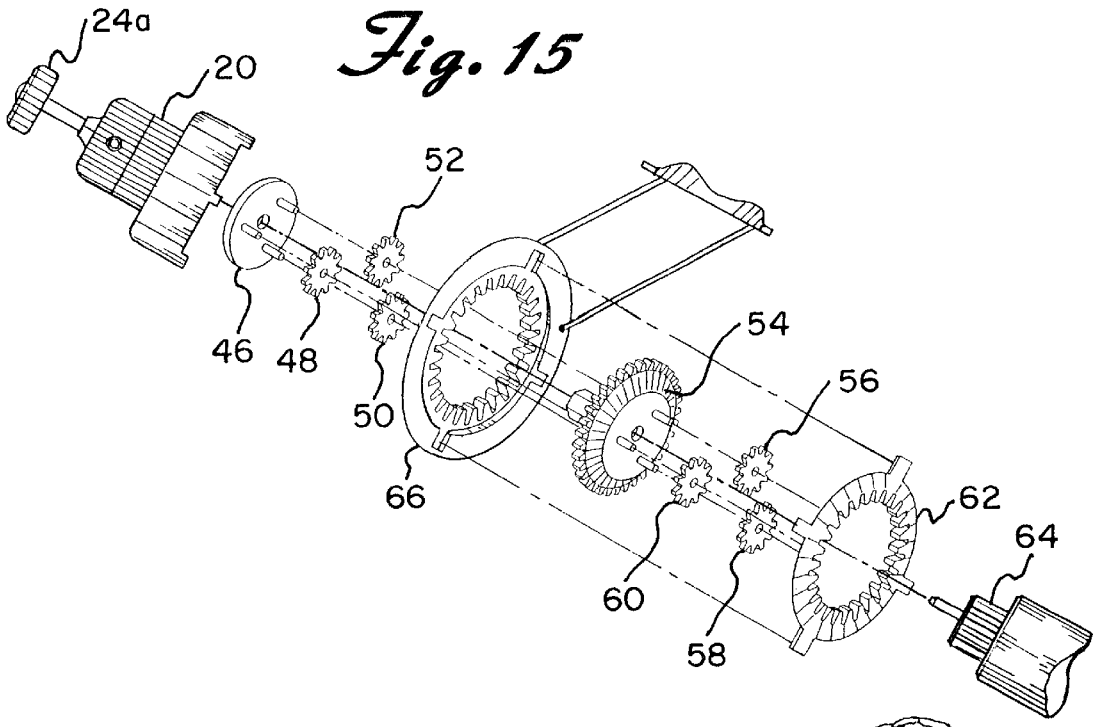
FIG. 15 is an exploded view of the geared mechanism portion of the exercise device of the present invention.

The chucks 20 and 22 are internally connected to small geared mechanisms, with each chuck having its own set of gears on each end of the exercise device. FIG. 15 illustrates the internal composition of just one chucked end of the exercise device connecting to its one individual set of geared mechanisms. The turning knob 24*a*, when rotated, turns the chuck 20 which turns a disc 46 which turns three small gears 48, 50, and 52 which turn disc 54. Disc 54 is similar to disk 46 except that its entire perimeter is toothed or geared. Disc 54 also has a gear permanently affixed to its backside. Disc 54 turns another set of three small gears 56, 58, and 60 which all ride along the inside of a toothed ring 62. Ring 62 is stationary and does not move with any of the other moving gears. Next, the gears 56, 58, and 60 move a final gear 64 which connects to a shaft. When using the device, a person's hand manually turns the gears when the knob is rotated.

The series of gears, when working in combination with each other, produces the frictional turning resistance needed for the device. The switch 42 or 44, used for adjusting resistance, is connected to a large ring 66 with geared teeth on its inside perimeter. When this switch is positioned back, away from the chuck area, the large ring 66 drops or wedges down into a recessed seat towards the chuck area and locks into a stationary position allowing only the three small moveable gears 48, 50, and 52 to move. While the switch is in this position, only the three small gears 48, 50, and 52 ride along the inside of this now stationary large ring 66 while the chuck is being turned. When the switch is positioned forward towards the chuck area, the large ring 66 raises up, out of its recessed seat, and this time, not only surrounds the three small gears 48, 50, and 52 as before, but now also surrounds the larger geared perimeter section of disc 54. Since the large ring 66 is no longer locked in its recessed position as before, it is now in a floating position while it surrounds both sets of gears 48, 50, and 52 and 56, 58, and 60 and moves along with them as one. Because of the large ring 66, the chuck and the turning knob, become much easier to turn. Thus, the present invention provides adjustable grades or levels of turning knob resistance, all with the touch of a switch.

Each of the two chucked ends has its own set of gear adjustments. One chucked end of the device would produce a series of different levels of lower turning resistance, or easier turning tension. Internally it would consist of smaller, geared mechanisms with smaller, finer teeth while the opposite end of the device would produce a series of different levels of higher turning resistance or harder turning tension, internally consisting of larger geared mechanisms with larger, coarser teeth.

Adjustable levels of prehension are accomplished through the use of different shapes and styles of turning knobs that can be connected and locked into the two chucks of the exercise device. FIGS. 7–13 illustrate a few examples of many different shapes and styles of turning knobs that can be used.

Figure 14:
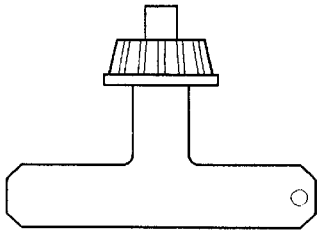
FIG. 14 illustrates a locking key that can be used to lock or unlock chucks on the exercise device of the present invention when changing to different styles of turning knobs.

The turning knobs 24*a* and 24*b* may be made from plastic, metal, or the like. The connecting rods or shafts 68 and 70 are connected into chucks 20 and 22, respectively. The chucks may be made from metal, plastic, or the like. The chucks 20 and 22 lock the rods 68 and 70 of the turning knobs 24*a* and 24*b,* respectively, into place. Three types of chucks may be used. Two of the chucks may be keyless and one may be standard. Chuck 20, for example, is the standard type that must utilize a locking key, while chuck 22 is keyless and may be locked or unlocked simply by use of the hand. Chuck 22 can be one of the two basic types of keyless chucks, that is, either the push-pull, quick-disconnect style or the turn and locking style. A key with a male toothed end may be used to lock and unlock the standard types of chucks. (See FIG. 14.)

Figure 16:
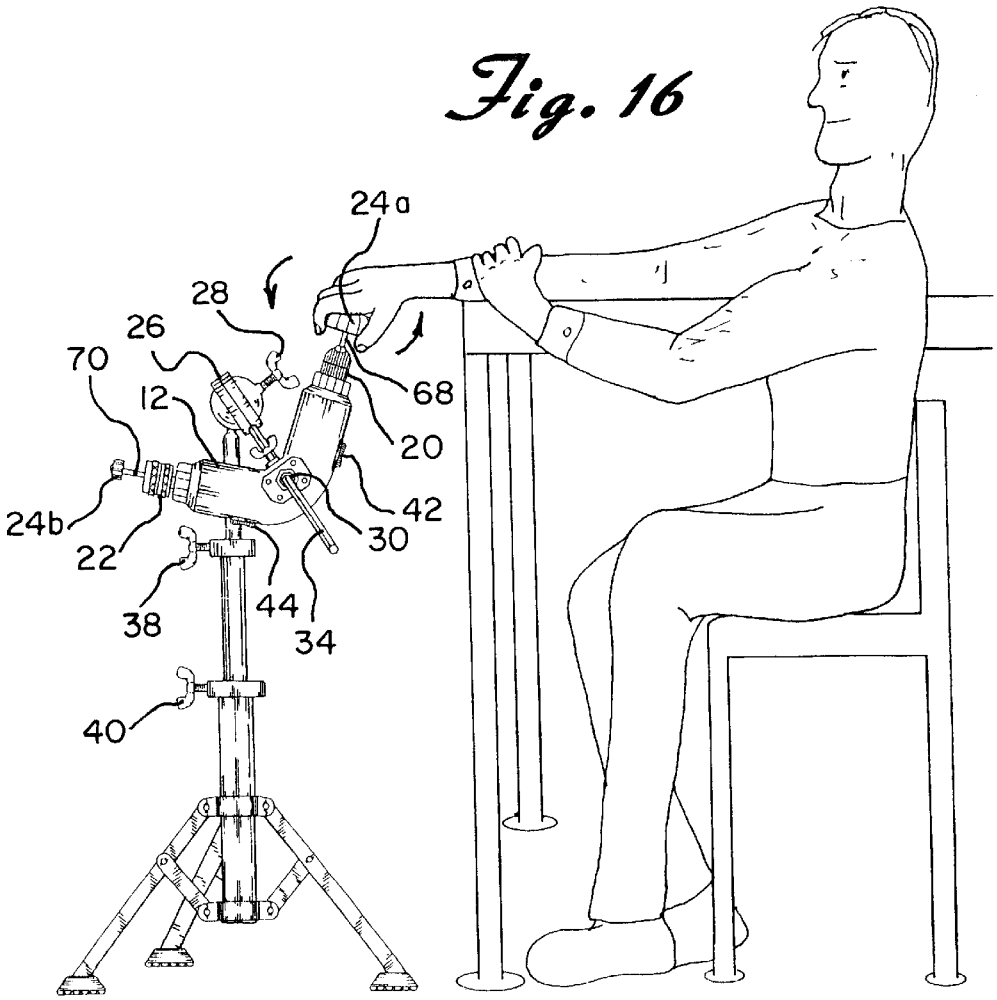
FIG. 16 illustrates a person using the present invention in a rehabilitative manner.

One of the advantages of the present invention is that the turning means allow for unlimited turning in either direction without change in resistance. Also, because the device is supported by an adjustable stand, it can be positioned next to any raised platform, such as an edge of a table top, sofa or arm chair rest. (See FIG. 16.)Thus, a person is able to actually brace the forearm or wrist being exercised with the other hand, thereby isolating a desired part of the limb from any movement involved with the exercise device. By doing this, a person would be able to directly target a specific area for full concentration of treatment from the exercise.

The present invention may be embodied in other specific forms without departing from the spirit or essential attributes thereof and accordingly, reference should be made to the appended claims rather than to the foregoing specification as indicating the scope of the invention.

I claim:

1. An adjustable rehabilitation exercise device comprising:

an elongated body having a first end and second end;

first turning mean secured to said first end and second turning means secured to said second end;

means for supporting said elongated body wherein said support means allows said elongated body to be rotated and the height of said elongated body to be adjusted; and means for securing said elongated body to said supporting means, said securing means including a ball clamp assembly.

2. The adjustable rehabilitation exercise device of claim 1 wherein each of said first an second ends of said elongated body includes means for holding said first and second turning means.

3. The adjustable rehabilitation exercise device of claim 1 wherein said turning means includes knobs.

4. The adjustable rehabilitation exercise device of claim 1 wherein said supporting means includes a tripod.

5. The adjustable rehabilitation exercise device of claim 1 further including means for adjusting the level of resistance felt as each of said turning means is rotated.

6. The adjustable rehabilitation exercise device of claim 5 wherein said adjusting mean includes a switch and a series of gears and discs.

7. The adjustable rehabilitation exercise device of claim 1 wherein said body is angled.

* * * * *